United States Patent [19]

Lombardi

[11] Patent Number: 4,756,224

[45] Date of Patent: Jul. 12, 1988

[54] DRUM BEATING APPARATUS WITH ECCENTRIC ROTOR

[76] Inventor: Donald G. Lombardi, 2118 E. Hillcrest Dr., Thousand Oaks, Calif. 91360

[21] Appl. No.: 1,356

[22] Filed: Jan. 8, 1987

[51] Int. Cl.[4] ..... G10D 13/00

[52] U.S. Cl. ..... 84/422 R

[58] Field of Search ..... 84/422 R

[56] References Cited

U.S. PATENT DOCUMENTS

| | | | |
|---|---|---|---|
| 2,785,596 | 3/1957 | Korosh | 84/422 R |
| 3,316,792 | 5/1967 | Ippolito | 84/422 R |
| 3,797,356 | 3/1974 | Duffy et al. | 84/422 R |
| 3,930,431 | 1/1976 | Magadini | 84/422 R |
| 4,235,146 | 11/1980 | Purdy | 84/422 R |
| 4,538,499 | 9/1985 | Livingston | 84/422 R |

*Primary Examiner*—Lawrence R. Franklin

*Attorney, Agent, or Firm*—William W. Haefliger

[57] ABSTRACT

A foot-operated, bass drum pedal assembly is provided. It includes:

(a) a forwardly elongated, horizontally extending base plate, (b) a sub-assembly including two upright pedestals and a yoke, the yoke attached to the base plate, (c) an axle shaft extending between and rotatably supported by the two pedestals, and defining an axis, (d) a drum stick carried by the axle shaft to be rotated thereby, and beat a drum, (e) a toothed sprocket mounted on the shaft to rotate same, about the axis, (f) a chain entrained on the sprocket teeth and having opposite end portions one of which is anchored to the sprocket, above the base plate, the chain extending at increasing distance from the axis along the chain length on the sprocket in a direction away from the anchored end portion, and (g) a pedal extending in inclined relation to and above the base plate, the pedal having a rear end portion pivotally connected to the base plate near the rearward end thereof, the pedal having a forward end portion attached to the other end portion of the chain, below the level of the sprocket, and above a forward end portion of the base plate.

13 Claims, 2 Drawing Sheets

DRUM BEATING APPARATUS WITH ECCENTRIC ROTOR

BACKGROUND OF THE INVENTION

This invention relates generally to improvements in bass drum beating equipment; more particularly it concerns enhanced drum beating capability and speed of beater movement toward the drum, and enhanced stability, support and integration of such apparatus to improve its operability, use, and lengthen the life of such equipment.

Prior drum beating mechanisms as disclosed for example in U.S. Pat, Nos. 3,797,356; 2,845,830; 3,195,391; 3,543,632; 3,742,806; 4,188,853; and 3,750,517 lacked the unusual advantages and combinations of advantages, structurally and functionally, of the present invention. For example, prior drum beaters were collapsible, which weakened them structurally in use, and they tended to move about during foot pedaling. Also, beater movement in response to pedal movement was too slow for many drummers. The present invention represents a substantial and unusual advance over the prior art, and fills a need for the above advantages as well as additional advantages as will appear.

SUMMARY OF THE INVENTION

Basically, the invention is embodied in a foot-operated, bass drum pedal assembly and includes in combination:

(a) a bottom, horizontally extending support plate, (b) two upright members attached to and supported by the plate, (c) a horizontal axle supported by said members for rotation about a horizontal axis, (d) a sprocket carried by the axle at a support location, the sprocket having peripheral chain engaging teeth, and a chain meshing with said teeth, an end portion of the chain anchored to the sprocket, the chain having a dangling portion extending below the sprocket, (e) the chain having a mid-portion meshing with said teeth and being at increasing distance from said axis along the chain length in a direction toward said dangling portion, (f) a pedal having a rear portion hingedly supported by the plate and a front portion attached to said dangling portion of the chain, and (g) the drum beater attached to said axle, to be rotated thereby.

As will appear, the speed of reaction of the beater in response to pedal movement is thereby enhanced for more accurately timed drum beating; and pedal return to up-position is accelerated, to more quickly position the pedal for a subsequent, down push, for the next drum beat.

Additional objects include the provision of a heel pad anchored to the support plate immediately rearward of the pedal, and having an upper surface presented upwardly to provide a heel supportive rearward continuation of the upper surface of the pedal rearwardmost extent; a piano hinge between the pedal rearwardmost extent and said heel pad, the piano hinge having two leaves, one leaf attached to said heel pad and the other leaf attached to said pedal rearwardmost extent, at the underside thereof; and two support struts extending from said heel pad forwardly along the upper side of the base plate and then upwardly to connect to the two pedestals, respectively, above the level of the base plate.

A clamp finger is typically carried by a yoke, attached to the support plate and is attachable to a bass drum rim that overhangs the forwardmost extent of the base plate; and the clamp finger is typically rotatably carried by the yoke, the yoke having two forwardly extending tongues beneath the level of said clamp finger, and supported by the base plate forwardmost extent, the tongues adapted to support the lower side of the bass drum rim, the upper side of which is clamped by said finger.

Further objects include the provision of a shaft end that projects through one of the pedestals, a crank attached to said shaft end, a series of adjustment holes in said crank spaced about an axis defined by the shaft, and a return spring operatively connected to the crank via one of said holes, and to the one pedestal at a lower level, above the level of the base plate, for returning the drum stick to a retracted position, relative to the drum.

As will be seen an elastomer layer may be attached to the underside of said base plate, which is metallic, to grip the floor surface on which the base plate rests, to prevent plate slippage during heavy foot force and impact transferred to the pedal and base plate.

These and other objects and advantages of the invention, as well as the details of an illustrative embodiment will be more fully understood from the following specification and drawings, in which:

DRAWING DESCRIPTION

DETAILED DESCRIPTION

Figure 1:
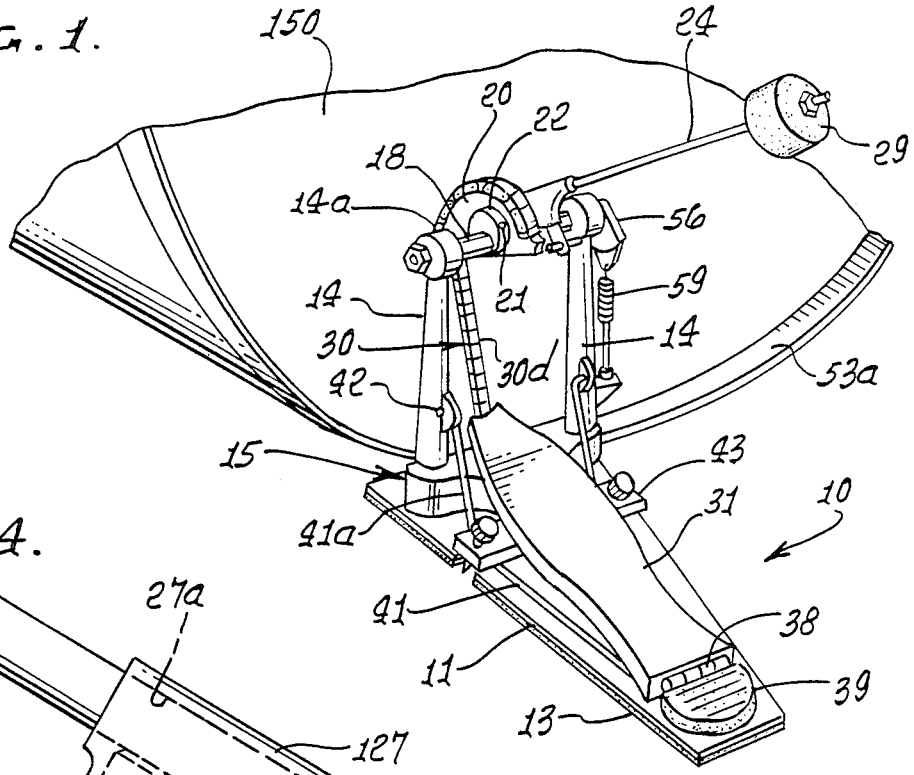
FIG. 1 is a perspective view of drum beating apparatus incorporating the invention.

The foot-operated bass drum pedal assembly 10 illustrated includes forwardly longitudinally elongated, horizontal base plate 11 which is relatively heavy and metallic to anchor the device on a floor surface 12. In this regard, the plate may consist of steel, and typically carries an elastomer layer 13 such as rubber on its underside to grip the floor. The underside of layer 13 may be serrated to enhance the grip.

Mounted to the upper side of the plate is a sub-assembly that includes two upright laterally spaced pedestals 14 interconnected by a bottom yoke plate 15. These elements are also metallic, and may consist of steel. The yoke plate is attached to plate 11 by two threaded fasteners 16 and 17.

Figure 4:
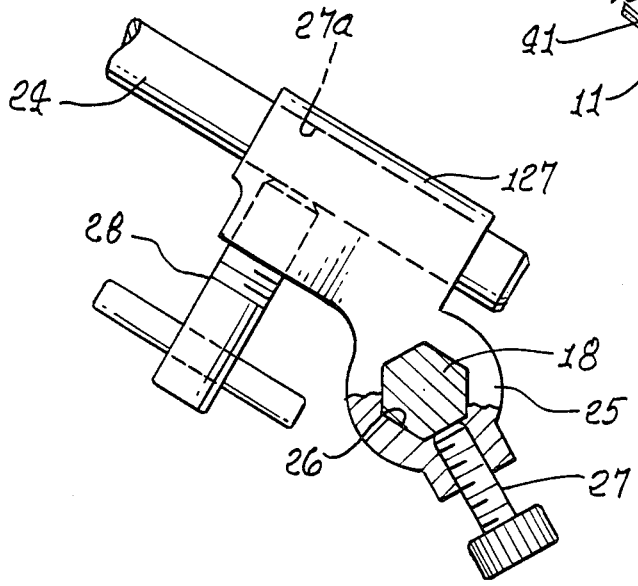
FIG. 4 is an enlarged fragmentary view showing drum stick connection to the shaft.

A horizontal shaft 18 extends laterally between, and is rotatably supported by the two pedestals, near their upper-most extent; to this end, suitable shaft bearings may be located in the pedestal enlarged end portions 14*a*. The shaft may be polygonal to mount a toothed sprocket 20, and the sprocket may have a corresponding polygonal bore to closely fit the shaft. A set screw 21 in sprocket hub 22 engages the shaft to position the sprocket on the shaft. The shaft also carries a drum stick or rod 24, via a hub 25 fitted on the shaft and shown in FIG. 4. The hub has a polygonal bore 26 to closely fit the shaft, in driven relation. A set screw 27 carried by the hub tightens against the shaft to locate the hub endwise thereon. A boss 127 integral with the hub has a bore 27*a* receiving the end of the shaft 24, and a set screw 28 carried by the boss 27 tightens against the shaft end to adjustably position the shaft end, endwise, in the boss. A beater head 29 is attached to the opposite and remote end of the shaft 24.

Figure 5:
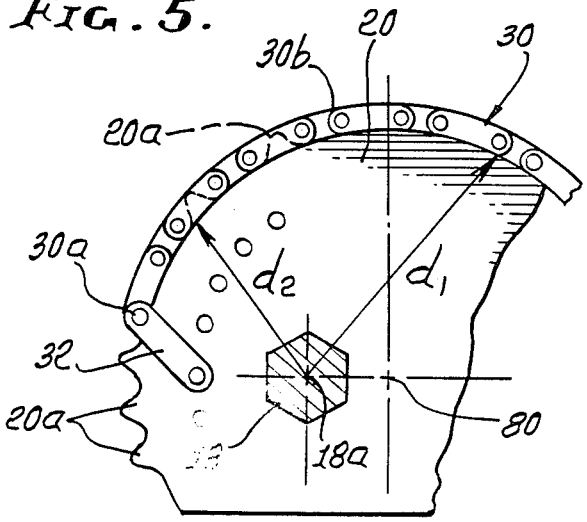
FIG. 5 is a fragmentary view showing sprocket and chain details.
Figure 6:
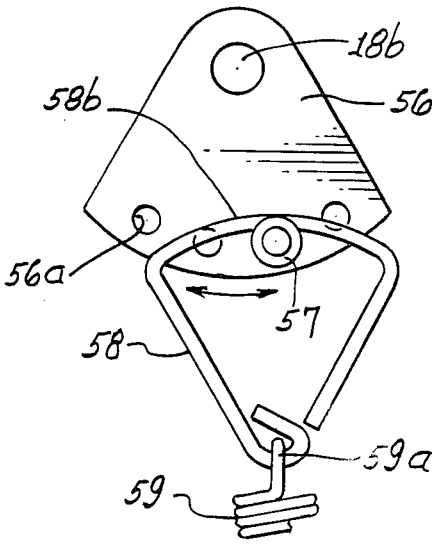
FIG. 6 is an enlarged view of spring attachment to the sprocket shaft.
Figure 2:
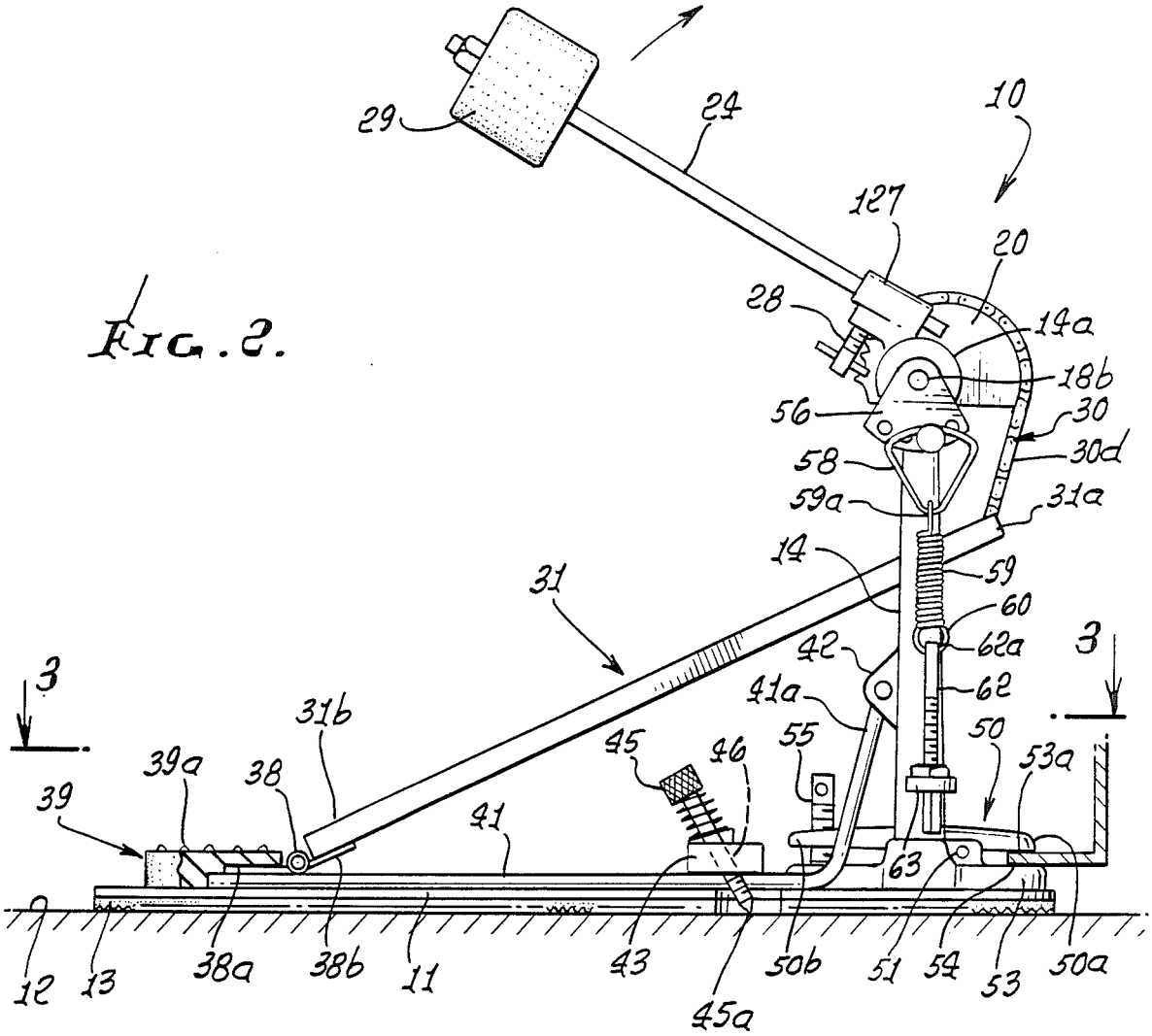
FIG. 2 is a side elevation showing the FIG. 1 apparatus.
Figure 3:
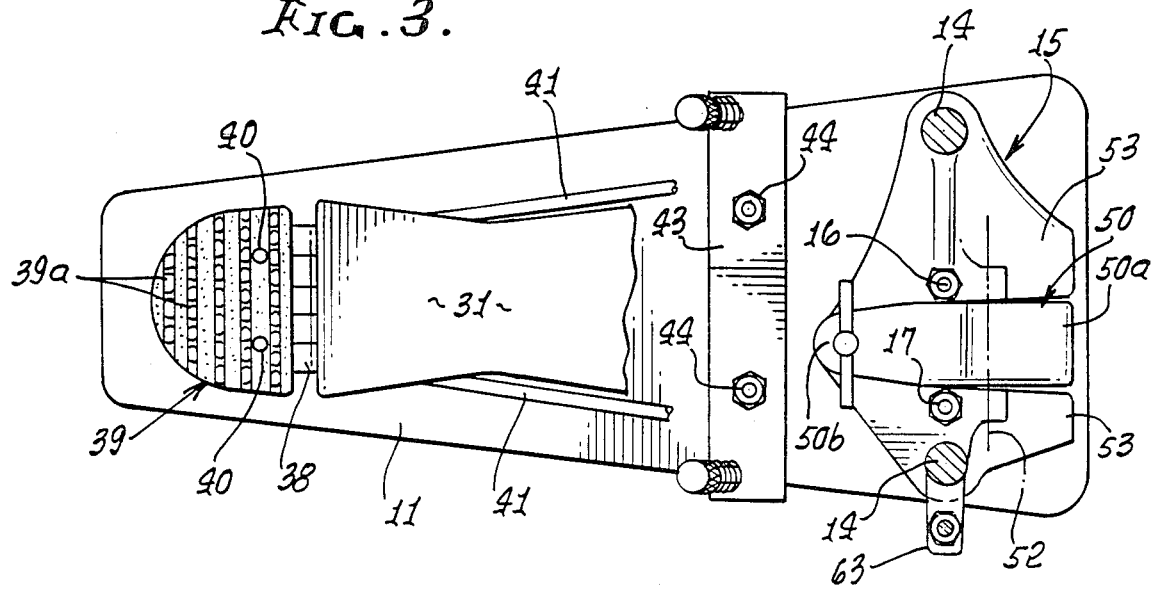
FIG. 3 is a top plan view taken on lines 3-3 of FIG. 2.

Flexible chain 30 is entrained on the sprocket teeth, and has opposite end portions, one of which is anchored to the sprocket at 30*a*, spaced above the base plate and above a pedal 31. FIG. 5 shows a chain anchor link 32 attached as by a fastener to the sprocket, and spaced about the sprocket and shaft axis of rotation. This enables adjustment of pedal angle of inclination relative to the base plate, as will appear. The forwardly elongated pedal extends in inclined relation above the base plate, and has a forward portion 31*a* of the pedal attached to the lower end of the chain dependent below the forwardmost extent of the sprocket, to be displaced downwardly as the pedal is pressed downwardly, thereby rotating the sprocket, shaft, and beater, to beat the bass drum 150.

It will be noted that the axis 18*a* of rotation of the sprocket and axle shaft 18 are eccentric relative to the sprocket teeth 20*a* engaged by the chain. In particular, the chain has a mid-portion 30*b* meshing with the teeth, and being at progressively increasing distance (compare large distance $d_1$ with lesser distance $d_2$, for example, in FIG. 5) from the axis 18*a*, along the chain length in a direction toward the dangling portion 30*a* below the sprocket. As a result, the pedal accelerates faster the travel of the beater toward the drum, as during initial rotation of the sprocket by the chain, due to the longer torque arms, of which $d_1$ is representative, relative to the shorter torque arms (as at $d_2$) which are in effect as the sprocket completes its rotation and as the beater closely approaches the drum. This also enables more accurate timing of drum beating. Also, the cam effect serves to move forwardly the chain extent hanging below the sprocket, as the chain returns to the spocket, thereby bringing the pedal up faster than if the sprocket rotated about its true center. The teeth are typically on a circle whose center is at 80 forward of axis 18*a*.

The pedal has a rear end portion 31*b* pivotally connected to the base plate near the rearward end thereof. Of unusual advantage for this purpose is a piano hinge 38 which extends transversely between the pedal rearwardmost extent and a heel pad 39. The hinge has two leaves, 38*a* and 38*b*. Leaf 38*a* projects rearwardly into the hard rubber heel pad to be anchored thereby, and the other leaf 38*b* is attached to the pedal rearwardmost extent, at the underside thereof. The heel pad is attached to the base plate, as by fasteners 40, and the treaded upper surface 39*a* of that pad is slightly higher in elevation than the top of the hinge 38.

Two support struts 41 typically in the form of steel rods, extend forwardly from the heel pad 39, in which they are embedded. The struts extend along the upper surface of the base plate, and then upwardly at 41*a* at a forward angle to connect to the two pedestals, at 42, for bracing same. A cross-piece 43 extends over the struts and is attached as by fasteners 44 to the base plate, thereby removably clamping the rods to the base plate, forwardly of heel pad 39. Bolts 45 are threadably attached at 46 to the cross-piece, and have tapered lower ends 45*a* that extend downwardly and forwardly at opposite lateral sides of the base plate, to adjustably penetrate or grip a floor surface for blocking forward bodily displacement of the base plate, in use.

A clamp finger 50 is rotatably carried by the yoke, as at lateral pivot locations 51, to pivot axis 52. The yoke also has two tongues 53 that extend forwardly beneath the level of the clamp finger, and at laterally opposite sides thereof, the tongues supported by the base plate. In use, the tongues support the downwardly convex lower side of the bass drum rim 53*a* as at locations 54. The upper side of the rim is downwardly clamped by the forward portion 50*a* of the finger 50. Downward pivoting of the finger forward portion is adjustably effected by a set screw 55 threaded through the rearward extent 50*b* of the clamp finger, and bearing against the yoke plate, rearward of axis 52.

Shaft 18 has an end portion 18*b* that projects through one of the pedestals and to which a crank 56 is attached. The crank has a series of adjustment holes 56*a* therein, and spaced about the shaft axis. A cam pin 57 is selectively positioned in one of such holes, and a lost motion connector 58 rides on the pin. An upright return spring 59 has its upper end attached to connector 58 at 59*a*, and its lower end adjustably attached to one pedestal at 60. The lost motion connector has a cam portion 58*b* which is downwardly concave and free to travel generally forwardly and rearwardly relative to pin 57 in an arc defined by the connector, as the shaft is rotated by the foot operated pedal, and as the crank is turned about the shaft axis to elevate and lower the connector, tensioning and relieving the beater return spring. A threaded connector 62 attached to the lower end of the spring at 62*a* is rotatable in a threaded opening in a lug 63 on the pedestal, to adjust the spring tension. During this adjustment, the connector 58 may be lifted off the pin 57, to allow rotation of the connector 62, for spring tension adjustment.

Accordingly, a sturdy, compact, reliable and more accurate pedal unit is provided.

I claim:

1. In drum beating apparatus, the combination comprising:

(a) a bottom, horizontally extending support plate, (b) two upright members attached to and supported by the plate, (c) a horizontal axle supported by said members for rotation about a horizontal axis, (d) a sprocket carried by the axle at a support location, the sprocket having peripheral chain engaging teeth, and a chain meshing with said teeth, an end portion of the chain anchored to the sprocket, the chain having a dangling portion extending below the sprocket, (e) the chain having a mid-portion meshing with said teeth and being at increasing distance from said axis along the chain length in a direction toward the said dangling portion, (f) a pedal having a rear portion hingedly supported by the plate and a front portion attached to said dangling portion of the chain, (g) and a drum beater attached to said axle, to be rotated thereby, so that as the pedal moves down causing the drum beater to move toward the drum the effective length of the torque arm exerted on the sprocket by the chain is caused to decrease.

2. In a foot-operated, bass drum pedal assembly, the combination comprising:

(a) a forwardly elongated, horizontally extending base plate, (b) a sub-assembly including two upright pedestals and a yoke, the yoke attached to the base plate, (c) an axle shaft extending between and rotatably supported by the two pedestals, and defining an axis, (d) a drum stick carried by said axle shaft to be rotated thereby, to beat a drum, (e) a toothed sprocket mounted on the shaft to rotate same, about said axis, (f) a chain entrained on the sprocket teeth and having opposite end portions one of which is anchored to the sprocket, above the base plate, the chain extending at increasing distances from the axis along the chain length away from said anchored end portion, and (g) a pedal extending in inclined relation to and above the base plate, the pedal having a rear end portion pivotally connected to the base plate near the rearward end thereof, the pedal having a forward end portion attached to the other end portion of the chain, below the level of the sprocket, and above a forward end portion of the base plate, (h) whereby as the pedal moves downward causing the drum stick to move toward a drum, the effective length of the torque arm exerted on the sprocket by the chain is caused to decrease.

3. The combination of claim 2 including a heel pad anchored to the base plate immediately rearward of the pedal, and having an upper surface presented upwardly to provide a heel supportive rearward continuation of the upper surface of the pedal rearwardmost extent.

4. The combination of claim 3 including a piano hinge between the pedal rearwardmost extent and said heel pad, the piano hinge having two leaves, one leaf attached to said heel pad and the other leaf attached to said pedal rearwardmost extent, at the underside thereof, and including two support struts extending from said heel pad forwardly to connect to the two pedestals, respectively, above the level of the base plate, and a cross-piece extending laterally over the struts, the cross-piece removably anchored to the base plate, and removably anchoring the struts to the base plate, forwardly of said heel pad.

5. The combination of claim 2 including a clamp finger carried by said yoke and attachable to a bass drum rim that overhangs the forwardmost extent of the base plate.

6. The combination of claim 5 wherein the clamp finger is rotatably carried by the yoke, the yoke having two forwardly extending tongues beneath the level of said clamp finger, and supported by the base plate forwardmost extent, said tongues adapted to support the lower side of the bass drum rim, the upper side of which is clamped by said finger.

7. The combination of claim 2 wherein said shaft has an end that projects through one of said pedestals, a crank attached to said shaft end, a series of adjustment holes in said crank spaced about an axis defined by the shaft, and a return spring operatively connected to the crank via one of said holes, and to said one pedestal at a lower level, above the level of the base plate, for returning the drum stick to a retracted position, relative to the drum.

8. The combination of claim 7 including a cam pin selectively positioned in one of said holes, and a lost-motion connector riding on the pin and to which the return spring is attached, the lost-motion connector free to travel along a generally forwardly and rearwardly extending arc defined by the connector, as the shaft is rotated by the pedal.

9. The combination of claim 2 including an elastomer layer attached to the underside of said base plate, which is metallic.

10. In a drum beating assembly the combination comprising:

(a) a base in the form of a metal plate, a first drum beater, a support for the beater mounted on the base, and a pedal pivotally mounted to the base and operatively connected to the beater to pivot same as the pedal is pivoted by the drummer's foot, (b) said support including two upright pedestals and a yoke supporting the pedestals, the yoke attached to the base forwardly of the pedal pivoted mounting to the base, an axle shaft carried by the pedestals, and a sprocket eccentrically mounted on the axle shaft to rotate about an axis, and a chain entrained on the sprocket and connected to the pedal, (c) the sprocket having teeth and the chain meshing with the sprocket teeth at increasing distances from the axis along the chain length away from an end portion of the chain anchored to the sprocket, (d) whereby as the pedal moves downward causing the drum stick to move toward a drum, the effective length of the torque arm exerted on the sprocket by the chain is caused to decrease.

11. The combination of claim 10 including a heel pad attached to the base plate and located directly rearwardly of the pedal, and two support struts anchored to the base via the heel pad and extending forwardly and upwardly to attach to the two pedestals, respectively, and a cross-piece extending over and anchoring the struts to the base plate, forwardly of the heel pad, and means carried by the cross-piece to project and engage a floor surface to resist displacement of the base plate.

12. In a foot-operated bass drum pedal assembly, the combination comprising:

(a) a forwardly elongated, horizontally extending base plate, (b) a sub-assembly including two upright pedestals and a yoke, the yoke attached to the base plate, (c) a shaft extending between and rotatably supported by the two pedestals, and defining an axis, (d) a drum stick carried by said shaft to be rotated thereby, to beat a drum, (e) a rotor mounted on the shaft to rotate same about said axis, (f) an elongated flexible connector entrained on the rotor and having opposite end portions one of which is anchored to the rotor above the base plate, the connector extending at increasing distances from said axis along the connector length on the rotor in a direction away from the end portion anchored to said rotor, whereby the rotor is eccentrically mounted on the shaft, (g) a pedal extending in inclined relation to and above the base plate, the pedal having a rear end portion pivotally connected to the base plate near the rearward end thereof, the pedal having a forward end portion attached to the other end portion of the connector, below the level of the rotor, and above a forward end portion of the base plate, (h) a heel pad anchored to the base plate immediately rearward of the pedal, and having an upper surface presented upwardly to provide a heel supportive rearward continuation of the upper surface of the pedal rearwardmost extent, (i) said plate being elongated to have opposite elongated side edges, and opposite end edges, said yoke beneath the pedestals having opposite edges proximate the respective side edges of the plate, said drum stick and beater defining a plane of rotation which is vertical and which approximately bisects the plate between said plate opposite elongated side edges, and which intersects the pad, the connector above the pedal and below the rotor moving forward on up-movement of the pedal, (j) whereby as the pedal moves downward causing the drum stick to move toward a drum, the effective length of the torque arm exerted on the rotor by the connector is caused to decrease.

13. In a foot-operated, sound producing assembly, the combination comprising:

(a) a forwardly elongated, horizontally extending base plate, (b) a sub-assembly including two upright pedestals and a yoke, the yoke attached to the base plate, (c) a shaft extending between and rotatably supported by the two pedestals, (d) operating means carried by said shaft to be rotated thereby, to operate a sound producing device, (e) a toothed sprocket eccentrically mounted on the shaft to rotate same, about an axis, (f) chain entrained on the sprocket and having opposite end portions one of which is anchored to the sprocket, above the base plate, the chain increasingly spaced from said axis along chain length on the sprocket, in a direction away from said anchored end portion, (g) a pedal extending in inclined relation to and above the base plate, the pedal having a rear end portion pivotally connected to the base plate near the rearward end thereof, the pedal having a forward end portion attached to the other end portion of the chain, below the level of the sprocket, and above a forward end portion of the base plate, (h) a heel pad anchored to the base plate immediately rearward of the pedal, and having an upper surface presented upwardly to provide a heel supportive rearward continuation of the upper surface of the pedal rearwardmost extent, (i) and including two support struts extending from said heel pad forwardly along the upper side of the base plate and then upwardly to connect to the two pedestals, respectively, above the level of the base plate, and a cross-piece extending laterally over the struts, the cross-piece removably anchored to the base plate, and removably anchoring the struts to the base plate, forwardly of said heel pad, (j) said plate being elongated to have opposite elongated side edges, and opposite end edges, said yoke beneath the pedestals having opposite edges proximate the respective said edges of the plate, said means carried by the shaft defining a plane of rotation which is vertical and which approximately bisects the plate between said plate opposite elongated side edges, and which intersects the pad, (k) whereby as the pedal moves downward to cause said operating means to be rotated toward said sound producing device, the effective length of the torque arm exerted by the chain on the sprocket progressively decreases.

* * * * *